US006418753B1

(12) United States Patent
Voit et al.

(10) Patent No.: US 6,418,753 B1
(45) Date of Patent: Jul. 16, 2002

(54) METHOD AND DEVICE FOR CRYOGENIC AIR SEPARATION

(75) Inventors: Jürgen Voit, Schondorf; Gerhard Pompl, Beilngries, both of (DE)

(73) Assignee: Linde Aktiengesellschaft, Wiesbaden (DE)

( * ) Notice: Subject to any disclaimer, the term of this patent is extended or adjusted under 35 U.S.C. 154(b) by 0 days.

(21) Appl. No.: 09/762,196

(22) PCT Filed: Aug. 5, 1999

(86) PCT No.: PCT/EP99/05678

§ 371 (c)(1),
(2), (4) Date: Feb. 5, 2001

(87) PCT Pub. No.: WO00/08399

PCT Pub. Date: Feb. 17, 2000

(30) Foreign Application Priority Data

| | | |
|---|---|---|
| Jun. 8, 1998 | (DE) | 198 35 974 |
| Nov. 11, 1998 | (DE) | 198 52 020 |
| Nov. 12, 1998 | (EP) | 98123463 |

(51) Int. Cl.[7] ..... F25J 1/00
(52) U.S. Cl. ..... 62/643; 62/646; 62/925
(58) Field of Search ..... 62/643, 925, 646

(56) References Cited

U.S. PATENT DOCUMENTS

| | | | |
|---|---|---|---|
| 4,091,633 A | 5/1978 | Gerhard | |
| 4,732,597 A | 3/1988 | Jujasz et al. | |
| 5,067,976 A | * 11/1991 | Agrawal et al. | 62/925 |
| 5,313,802 A | 5/1994 | Agrawal et al. | |
| 5,629,208 A | 5/1997 | Darredeau et al. | |

FOREIGN PATENT DOCUMENTS

| | | |
|---|---|---|
| DE | 3322473 | 1/1985 |
| EP | 636576 | 2/1995 |

OTHER PUBLICATIONS

Wenning: "Lachgas in luftzerlegungsanlagen" Linde Berichte aus Technik und Wissenscraft, vol. 77 (1998) pp. 32–36.

* cited by examiner

*Primary Examiner*—Ronald Capossela
(74) *Attorney, Agent, or Firm*—Millen, White, Zelano & Branigan, P.C.

(57) ABSTRACT

The process and the apparatus serve for the low-temperature fractionation of air. Compressed and prepurified feed air (3, 5) is introduced into a rectification system for nitrogen-oxygen separation which has a pressure column (6). At least a part of the compressed and prepurified feed air is fed (5) to the pressure column (6). An oxygen-enriched fraction (13) is taken off from the pressure column (6) and passed (14) to a further working step (7) within the rectification system. The oxygen-enriched fraction (13) is taken off at least one theoretical or actual plate (15) above the point at which the compressed and prepurified feed air (5) is fed to the pressure column. From the bottom of the pressure column (6) a purge fraction (16) is removed in the. liquid state, fed in the liquid state to a purification stage (17), in which $N_2O$ is removed, and is taken off from the purification stage (17) as purified purge fraction (18).

18 Claims, 4 Drawing Sheets

METHOD AND DEVICE FOR CRYOGENIC AIR SEPARATION

Figure 1:
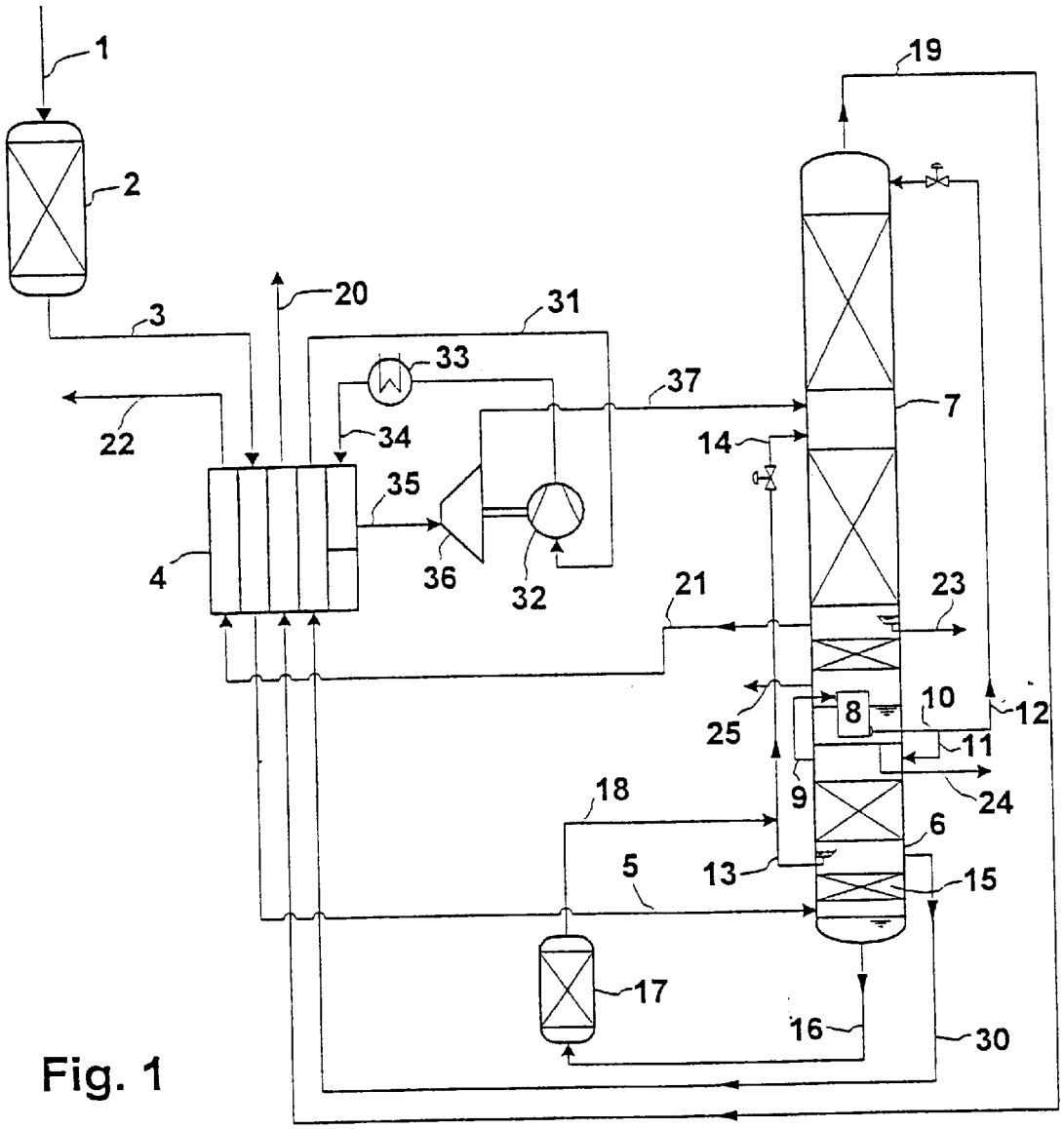

The invention relates to a process for the low-temperature fractionation of air in which compressed and prepurified feed air is introduced into: a rectification system for nitrogen-oxygen separation, which rectification system has a pressure column, where at least a part of the compressed and prepurified feed air is fed to the pressure column and where an oxygen-enriched fraction is taken off from the pressure column and passed to a further working step within the rectification system.

Processes of this type are disclosed, for example, by Hausen/Linde, Tieftemperaturtechnik [low-temperature engineering], 2nd edition 1985, Chapter 4 (pages 281 to 337). The rectification system for nitrogen-oxygen separation can be a one-column system having a single column, the pressure column in the context of the invention, a two-column system having a pressure column and a low-pressure column or a multi-column system. having further separation columns for nitrogen-oxygen separation. Hausen/Linde shows a plurality of examples of one-column systems (page 282, FIGS. 4.1. and 4.2.; page 287, FIG. 4.4; pages 329/330, FIGS. 4.30., 4.31. and 4.32.); the invention can be applied especially to a single column with top cooling via an oxygen-enriched liquid from the pressure column (Hausen/Linde, page 330, FIG. 4.31). Examples of two-column systems may also be found in Hausen/Linde (page 284, FIG. 4.3. and various examples in Sections 4.5.1 and 4.5.2). To generate ascending vapour for the low-pressure column, a part of the bottom liquid is evaporated in a condenser-evaporator (usually termed main condenser) which is operated, for example, with a gas fraction from the pressure column or with air as heating medium. The condenser-evaporator can be implemented by one or more heat-exchange blocks which can be operated, for example, as circulation evaporator and/or falling-film evaporator.

The rectification system for nitrogen-oxygen separation in the context of the invention in addition comprises heat exchangers such as, for instance, condenser-evaporators which are required to operate the separation column(s) for the nitrogen-oxygen separation (especially the main condenser of a double column or the top condenser of a single column). The process of the invention and the corresponding apparatus can, if required, have, outside the rectification system for nitrogen-oxygen separation, additional separation columns for producing further air constituents, for example noble gases such as argon, helium, neon, krypton or xenon (see Hausen/Linde, Chapter 4.5.4).

Customarily, the oxygen-enriched fraction is taken off from the bottom region of the pressure column before it is passed to a further working step within the rectification system. This further working step can be formed, for example, by the further separation in the low-pressure column of a double-column system or by an evaporation, for example in the top condenser of a one-column system. By this means, all of the low-volatility contaminants of the feed air which were not removed in the prepurification upstream of the introduction into the rectification system are transported on into the subsequent working step together with the oxygen-enriched fraction. ("Low-volatility contaminants" is here taken to mean feed-air components whose boiling point is higher than that of oxygen.)

Such low-volatility contaminants can accumulate further, especially in subsequent evaporation processes. Some of these low-volatility substances, in particular $N_2$ O, can precipitate as solids and must be removed from time to time to avoid a blockage of heat-exchange passages in the corresponding evaporators (for example in the main condenser of a double-column system). To eliminate the solids which have settled out, the entire plant must be shut down. In the case of a large air fractionation plant, this can mean an operational shutdown of, for example, two to five days. This problem is discussed in Wenning, Lachgas in Luftzerlegungsanlagen [laughing gas in air fractionation plants], Linde-Berichte aus Technik und Wissenschaft, 77/1998, 32–36. Here, and in U.S. Pat. No. 5,629,208 the solution proposed is to eject $N_2O$ using a relatively intense flushing of the liquid arising in the main condenser. However, it has proved to be the case that this measure is not sufficient in all cases to avoid the operationally highly undesirable shutdown of the air fractionation plant.

As a solution to this problem, various methods available to those skilled in the art seem suitable.

Firstly, a purification device could be used which removes the unwanted substances from the oxygen-enriched fraction. In the course of this, for example, all of the oxygen-enriched fraction (the bottom-phase liquid of the pressure column in the case of a double column) is conducted in liquid form via an adsorber to remove $N_2O$. (Liquid adsorbers were previously used at the same point to remove acetylene.) This procedure solves the operational problems in the evaporator, but represents relatively high capital expenditure. In addition, the adsorber must be regenerated from time to time, which, even in the case of a switchable device, leads to further operational expenditure.

Secondly, U.S. Pat. No. 5,471,842 discloses ejecting low-volatility components as early as in the pressure column by withdrawing, at its bottom, a purge fraction in the liquid state and by taking off, above the air feed, the oxygen-enriched fraction to be processed further in the low-pressure column. The purge fraction here is brought in the liquid state to a very high pressure, vaporized in the main heat exchanger against highly compressed feed air, admixed to the feed air upstream of the air prepurification and passed with this feed air back into the pressure column. Although this method works, as specified in U.S. Pat. No. 5,471,842, for the ejection of $CO_2$ which is effectively retained in the prepurification molecular sieve, the problem of $N_2O$ is not mentioned in U.S. Pat. No. 5,471,842. The process there is unsuitable for reliable ejection of $N_2O$ (see article by Wenning, paragraph 6); under some circumstances blockage of the passages of the main heat exchanger can occur due to precipitated $N_2O$, which necessitated heating of this apparatus.

In a modification of the process proposed in U.S. Pat. No. 5,471,842 for $CO_2$ ejection, it would be possible to remove from the process completely the purge fraction withdrawn in the bottom of the pressure column by discarding it, if appropriate after recovery of some of its cold. The purge fraction can, for example, be directly discarded in the liquid state by discharging it, after removing it from the pressure column, into the atmosphere, for example via an ejector. Alternatively, it can be vaporized and/or heated by indirect heat exchange with a heating medium and then discarded in the gaseous state. By this means, some of the energy which is present in the purge fraction in the form of cold is recovered. The vaporization should take place at a temperature high enough that precipitation of low-volatility contaminants is avoided, for example by introducing the liquid purge fraction into a residual gas fraction at medium temperature. Another possibility is the recovery of the cold in a heat exchanger having switchable passages (Revex). All of these methods can be expedient in certain plants, but have the disadvantage that the separation work performed on the purge fraction is lost and thus there is a high operating expenditure in the form of additional energy consumption.

The object therefore underlying the invention is to design a process of the type mentioned at the outset and a corresponding apparatus in such a manner that the operating expenditure in the overall process can be kept particularly low.

This object is achieved by the features of Patent claim 1. In the process of the invention the purge fraction, which is formed by at least a part, preferably the whole, of the bottom liquid of the pressure column, is fed without prior vaporization to a device for removing $N_2O$.

As a result, the purified purge fraction can be fed downstream of this device to further working steps within or outside the rectification system for nitrogen-oxygen separation, without the accumulation of $N_2O$ threatening within the context of these working steps. The further working step can have, for example, a column for nitrogen-oxygen separation or a condenser-evaporator for generating reflux for such a column, for instance the low-pressure column of a two-column system for nitrogen-oxygen separation or the top condenser of the pressure column.

The mass transfer section between the point of the feed air supply (generally at the bottom of the pressure column) and the takeoff of the oxygen-enriched fraction permits a largely complete scrubbing of the low-volatility contaminants, in particular $N_2O$, from the feed air into the bottom phase of the pressure column. The mass transfer section is formed either by at least one actual plate or by a packing section having a separation action of at least one theoretical plate. Preferably, there are from 1 to 10, highly preferably from 3 to 5, theoretical or actual plates between air feed or pressure column bottom on the one hand and takeoff point of the oxygen-enriched liquid on the other hand. (In the event that solely actual plates are used in this section as mass-transfer elements, the figures apply to numbers of actual plates; if an arranged packing, dumped packings or combinations of different types of mass-transfer elements are-used, the figures apply to numbers of theoretical plates.)

In the context of the process of the invention, the pressure column can be implemented as a single vessel. As an alternative, different sections can be enclosed by separate vessels. For example, the mass-transfer section which serves for scrubbing out $N_2O$ can be constructed separately from the rest of the pressure column (see apparatus according to Patent Claim 11).

With a mass-transfer section of this type between air feed and takeoff of the oxygen-enriched fraction, the most important low-volatility contaminants can be held back virtually completely from subsequent working steps. The oxygen-enriched fraction, for example, comprises less than 1 ppb of $N_2O$ (molar concentration less than $10^{31\ 9}$), preferably the molar $N_2O$ concentration is $10^{31\ 12}$ or below.

The low-volatility contaminants such as $N_2O$ are removed with the liquid purge fraction from the bottom of the pressure column. The purge fraction can be taken off continuously or batchwise. The amount of purge fraction withdrawn is determined by the wanted or permitted concentration of low-volatility components in the purge fraction. Generally, it is set so that no solids precipitation occurs in the bottom of the pressure column; under some circumstances, however, a higher enrichment with solids precipitation is possible. The amount of purge fraction is, for example, at least 0.1 mol % of the amount of feed air fed into the pressure column, preferably 0.15 mol % to 10 mol %, very highly preferably 0.3 mol % to 5 mol %, of the amount of feed air. (The figures on the amount of purge fraction are, especially in the case of batchwise takeoff, to be understood as an average over time of the amount of purge fraction.)

As a side effect of the measures of the invention, there is established an improvement in product quality of the oxygen product which may be generated from the oxygen-enriched fraction.

Preferably, $N_2O$ is removed from the liquid purge fraction in the purification stage by physical adsorption. The purification stage is therefore formed by a liquid adsorber. This liquid adsorber can be designed to be substantially more compact than the liquid adsorbers which have been used previously for acetylene removal and via which was passed the entire oxygen-enriched fraction.

Alternatively, the $N_2O$ can be precipitated in a heat exchanger provided separately for this, by evaporating the liquid purge fraction in the purification stage by indirect heat exchange, $N_2O$ precipitating out as solid and/or liquid during the evaporation. They can be deposited in the heat exchanger in which the evaporation is carried out. The evaporation must be carried out in this case batchwise or in a switchable pair of recuperative or regenerative heat exchangers, so that the deposited solids can be removed at certain time intervals. However, it is also possible to take off liquid or solids arising and the purified purge fraction continuously.

Another possibility is to remove $N_2O$ from the purge fraction in the purification stage by counter-current mass transfer. In this case the purge fraction is introduced in the liquid state into an additional separation column, for example at an intermediate point or at the top. The bottom fraction of the separation column is, for example, discarded, while the overhead fraction is further processed, for example in the pressure column. Heat must be supplied to the bottom of the separation column, for example by indirect heat exchange with a warm stream (transfer of sensible heat) or with a condensing gas stream of suitable composition using an electrically operated heater. In the event that the purge fraction is not applied directly at the top, in addition top cooling is necessary, for example by indirect heat exchange with a vaporizing process stream of suitable composition and suitable pressure.

Generally, one of the three methods for $N_2O$ removal is employed. In principle, a combination of two or three variants is also possible; in an example case, the purification stage has both at least one adsorption bed and also at least one switchable pair of heat exchangers.

Alternatively or in addition to the abovementioned introduction into the rectification system for nitrogen-oxygen separation, the purified purge fraction can be fed at least partially to a working step outside this rectification system. Preference is given in this case to feeding it into a system for producing a noble gas, for example krypton and/or xenon, by rectification. Examples of systems of this type can be found in the earlier German patent application 19823526.7 and in the applications corresponding thereto of the same applicant, and also in EP 96610 A, EP 222026 A, DE 166763.9 A, DE 1122088 B or in Streich et al., Gewinnung von Edelgasen in Luftund Ammoniakanlagen [production of noble gases in air and ammonia plants], Linde-Berichte aus Technik und Wissenschaft, 37/1975, 10–14. The purified purge fraction is in this case preferably introduced in the liquid state at least partially into an exchange column which serves for incorporating krypton and xenon into an inert gas (nitrogen or argon). This exchange column can in addition receive the customary krypton- and xenon-containing feed, that is to say the liquid bottom fraction from the low-pressure column of a two-column system.

Preferably, in the process of the invention, the entire air, that is to say the entire feed air which is fractionated in the rectification system, is introduced into the pressure column. The entire feed air is preferably fed into the pressure column at least one theoretical or actual plate below the point at which the oxygen-enriched fraction is taken off. This thus avoids, via direct feed of air into further working steps within the rectification system (for example via an air turbine which leads to the low-pressure column of a two-column system), unwanted low-volatility contaminants from passing into a working step downstream of the pressure column.

In the context of the invention it is expedient if process refrigeration energy is produced by work expansion of an intermediate fraction which is taken off from the pressure column above the air feed. The takeoff point can be, for example, at the intermediate point at which the oxygen-enriched fraction is taken off, at the top of the pressure column, or at any point arranged between these two points. The intermediate fraction is virtually $N_2O$-free and can therefore, downstream of the work expansion, be fed to the low-pressure column.

Alternatively, or additionally, a part of the compressed and prepurified air can be branched off upstream of the pressure column and work-expanded; the expanded air, however, must not then be fed to the pressure column above the air feed or to a working step of the rectification system downstream of the pressure column, but is, for example, admixed to a residual stream and removed from the process.

The production of refrigeration energy can be increased by a pressure increase in the intermediate fraction. For this purpose, the intermediate fraction can be taken off from the pressure column, for example in the gaseous state, upstream of the work expansion, warmed and compressed in the gaseous state. It is expedient, for this compression, to use at least some of the mechanical energy which is produced in the work expansion. The pressure downstream of the compression is, for example, from 7 to 15 bar, preferably from 8 to 12 bar. The height of the pressure difference here depends, as in the paragraph below, on the refrigeration requirement of a specific plant.

Alternatively, the intermediate fraction is taken off from the pressure column in the liquid state upstream of the work expansion, subjected in the liquid state to a pressure increase, vaporized and warmed by indirect heat exchange. The liquid pressure increase leads to a pressure of, for example, from 7 to 15 bar, preferably from 8 to 12 bar.

Deviation from the customary procedure is also expedient in the event that the process of the invention is operated in association with an internal compression process in which a product stream is brought in the liquid state to pressure (for example from 7 to 50 bar, preferably from 9 to 30 bar) and is then vaporized against a heating fluid under high pressure (for example from 7 to 50 bar, preferably from 9 to 30 bar). (The pressures depend in the individual case on the product pressure required.) Instead of a part of the compressed and prepurified feed air, according to another variant of the invention, a virtually $N_2O$-free gas fraction from the pressure column is used as heating fluid. This is taken off at least one theoretical or actual plate above the point at which the compressed and prepurified feed air is fed, preferably at the intermediate point at which the oxygen-enriched fraction is taken off, at the top of the pressure column, or at a point disposed between these two points. The heating fluid is warmed, compressed and finally condensed against the product stream which is brought to pressure in the liquid state. The condensate is further processed at a suitable point, for example in the pressure column.

In the process of the invention, a part of the bottom liquid of the pressure column can be vaporized and the resultant gas can be passed back to the pressure column. This optional bottom heating of the pressure column is preferably effected by a condenser-evaporator which receives a flow of suitable process gas as heating medium. In this manner the throughput is increased in the section of the pressure column which is below the takeoff point of the oxygen-enriched fraction. By this means other substances, in particular krypton and/or methane are extracted into the bottom of the pressure column. This effect is further intensified if the pressure column has in this case a further mass-transfer section which is arranged below the point at which the compressed and prepurified feed air is introduced into the pressure column and has the scope of some theoretical plates.

The invention further relates to an apparatus for the low-temperature fractionation of air according to Patent Claim 11 or 12.

In particular in the retrofitting of existing plants with the process of the invention it can be expedient not to rebuild the column(s) on existing rectification system, but to use an additional precolumn which comprises the mass-transfer section between air feed and takeoff of the oxygen-enriched fraction. The pressure column in the context of the invention is then formed by the combination of this precolumn with a main column. The feed air in this case is passed into the precolumn. From the bottom of the precolumn the purge fraction is taken off in the liquid state. At the top of the precolumn gas is taken off at least one theoretical or actual plate above the air feed and passed into the lower region of the main column. The oxygen-enriched fraction is then taken off from the bottom of the main column. In the case of rebuilding a conventional plant, the main column is part of the existing rectification system. Via the earlier feed air line, the overhead gas of the precolumn is passed into the main column and the oxygen-enriched fraction can be taken off via the earlier bottom liquid line which is already present. The retrofitting can therefore be effected by providing a precolumn for retaining low-volatility contaminants such as $N_2O$. This method can also be expedient in the construction of a new air fractionation plant, for example- if a particularly low construction height is wanted.

Figure 2:
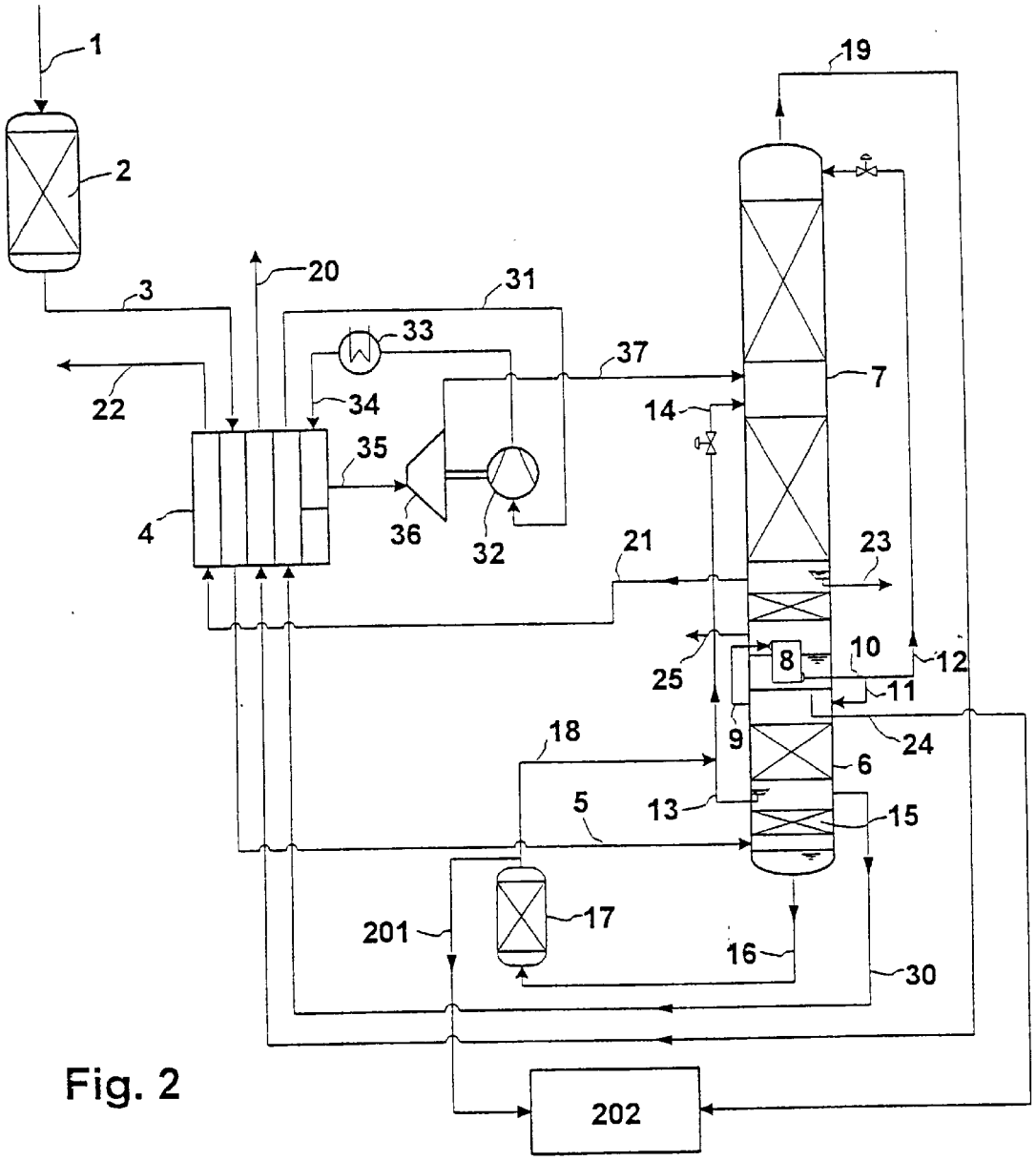
Figure 3:
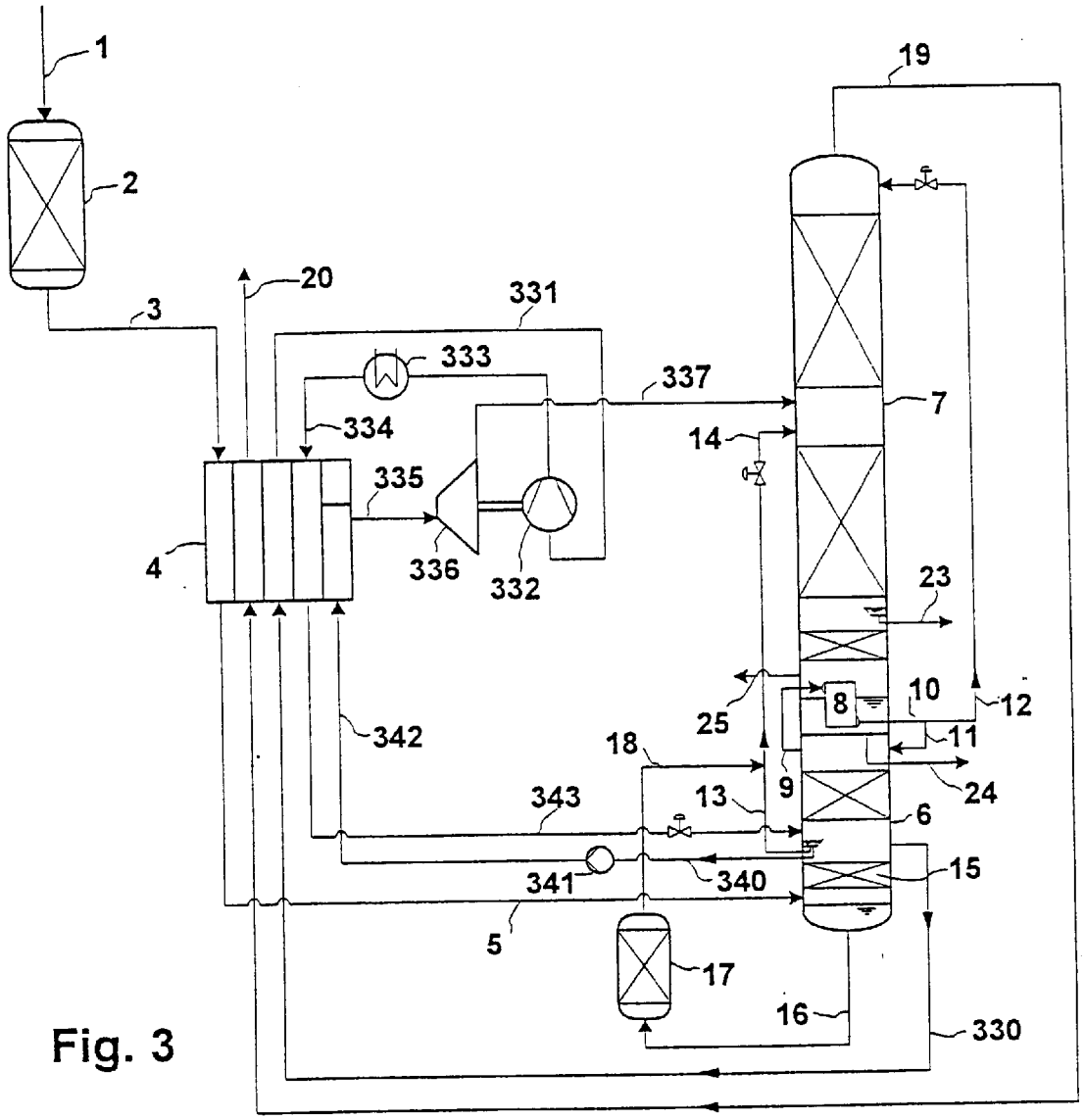
Figure 4:
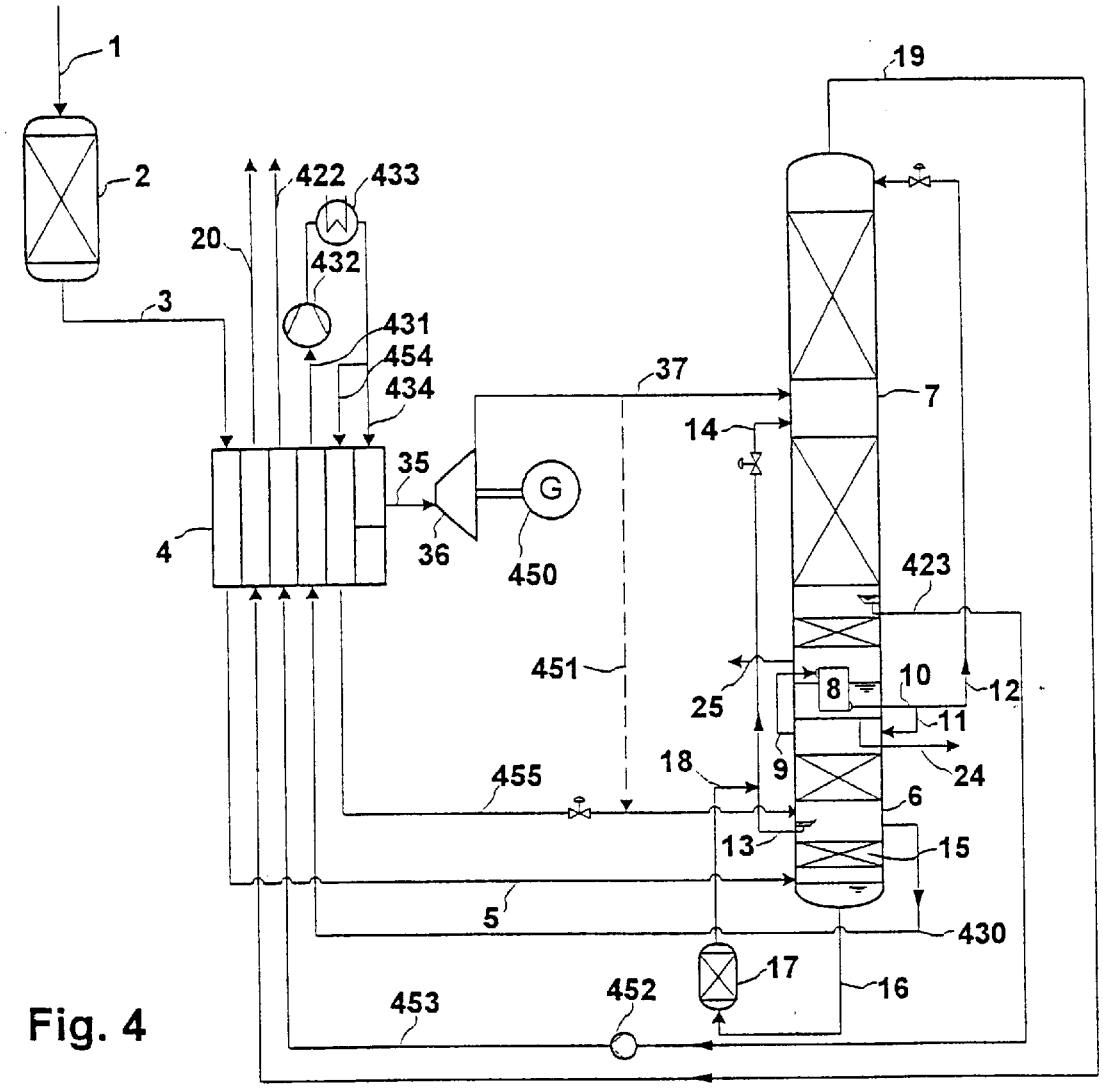

The invention and other details of the invention are described in more detail below with reference to illustrative examples shown diagrammatically in the drawings. In the drawings FIG. 1 shows an embodiment with an implementation of the invention for a two column apparatus, FIG. 2 shows an embodiment of the invention with the production of krypton and/or xenon, FIG. 3 shows a variant with a different method for producing process refrigeration energy and FIG.4 shows a process with production of pressurized oxygen by means of internal compression.

The drawing of FIG. 1 shows a double-column system for nitrogen-oxygen separation. Compressed feed air 1 is passed to a prepurification stage 2 and is there preferably subjected to an adsorption. In the course of this water vapour and $CO_2$ are virtually completely removed from the compressed feed air; in contrast, about from 20 to 50% of the $N_2O$ passes through a conventional molecular sieve. The prepurified feed air 3 is cooled in a main heat exchanger 4 in indirect heat exchange against fractionation products and all of it is fed via line 5 to the pressure column 6 of the rectification system. The rectification system for nitrogen-oxygen separation in addition has a low-pressure column 7 which is in a heat-exchange relationship with the pressure column 6 via a condenser-evaporator, the main condenser 8. At the top of the pressure column 6, pressurized nitrogen 9 is produced which is fed in part or completely to the main condenser 8 and there is condensed at least in part, preferably completely or essentially completely. A part 11 of the nitrogen 10 which is liquefied in the main condenser 8 is applied to the pressure column 6 as reflux. At least a part 12 of the residual condensate is conducted to the upper region of a low-pressure column 7. On the evaporation side of the main condenser 8 bottom liquid of the low-pressure column vaporizes. The vapour produced ascends in the low-pressure column in countercurrent to the reflux liquid. (The main condenser 8 in the illustrative example of the drawing is situated directly in the bottom of the low-pressure column; alternatively, it can also be disposed outside the double column.)

An oxygen-enriched fraction 13 is taken off in liquid form from the pressure column 6 and fed as further feed fraction to the low-pressure column 7 at an intermediate point (14). The oxygen-enriched fraction 13, in contrast to the prior art, is not taken off from the bottom of the pressure column, but from an intermediate point which is disposed above a mass-transfer section 15 which corresponds in the example to three theoretical plates. As a result it is free from low-volatility contaminants such as xenon, $C_2H_4$, $N_2O$ and $C_3H_8$. No $N_2O$ can thus pass into the low-pressure column 7 and lead to operating faults in the main condenser 8.

The low-volatility constituents are taken off with a liquid purge fraction 16 from the bottom of the pressure column 6 and fed in the liquid state to a purification stage 17 where $N_2O$ is removed. The $N_2O$ removal is effected in the illustrative example by means of adsorption. The purified liquid purge fraction 18 is fed together with the oxygen-enriched fraction 13 to the low-pressure column 7. Alternatively, a separate feed several plates lower is also possible. In the illustrative example, all of the feed air is fed via the line 5 into the pressure column 6, in particular no feed air passes without preliminary fractionation into the low-pressure column 7 (for example via a turbine).

The mass-transfer section 15 below the takeoff of the oxygen-enriched fraction 13 can be formed by any known mass-transfer element, for example by an arranged packing or any type of mass-transfer plates; preferably, sieve-plates are used, or in the case of a very small amount of purge fraction, bubble-cap trays and/or chimney trays.

In the example, the oxygen product is taken off from the low-pressure column 7 in the gaseous state via line 21, warmed in the main heat exchanger 4 and removed as product via line 22. The takeoff is disposed some theoretical or actual plates above the bottom of the low-pressure column, in order to keep low-volatility components such as krypton and/or xenon away from the oxygen product. These low-volatility components are taken off from the bottom liquid of the low-pressure column with a liquid-product stream or purge stream 24. Alternatively or in addition to this method, oxygen can be taken off as krypton-free and xenon-free liquid product via line 23 and/or as gaseous product which still comprises krypton and xenon via line 25. (The warming of the product to be taken off via line 25 and the subcooling of the oxygen-enriched fraction 13 are not shown in the drawing.)

A nitrogen-containing fraction 19 is taken off overhead from the low-pressure column 7 as gaseous nitrogen product or residual gas and warmed in the main heat exchanger 4. The warmed nitrogen-containing fraction 20 can be used in part as regeneration gas for the prepurification 2.

Process refrigeration energy is produced in the illustrative example by means of work expansion of an intermediate fraction 30 which is taken off in the gaseous state from the pressure column 6 at the height of the takeoff of the oxygen-enriched fraction 13 or above that. It is warmed in countercurrent to feed air 3 in the main heat exchanger 4, compressed in a compressor 32, for example from 5 bar to 7 bar, and after recooling 33 is fed back to the main heat exchanger 4 (line 34). The compressed air is taken off from the main heat exchanger at an intermediate temperature (line 35) and passed to an expansion machine 36. Downstream of the work expansion 36 to 1.2 bar, it is fed via line 37 to the low-pressure column 7 at an intermediate point. In the actual example, both the takeoff from the pressure column 6 and the feed into the low-pressure column 7 are at those intermediate points. at which the oxygen-rich fraction 13, 14 is also taken off or introduced. At least some of the energy required for compressing the warmed gas fraction 31 is formed by the mechanical energy produced by the work expansion 36; preferably, for this purpose, the expansion machine 36 and the compressor 32 are mechanically coupled. In certain cases the compression 32 can be absent; it is then sufficient to warm the gas fraction 30 only to a medium temperature and then to feed it directly via line 35 to the work expansion 36.

FIG. 2 shows a variant of the process according to FIG. 1, in which, in addition to oxygen and nitrogen, krypton and xenon are also produced. For this purpose, further process steps and devices for the krypton/xenon production are provided which are situated outside the rectification system for nitrogen-oxygen separation. These can make use of any of the known methods for krypton/xenon production from an oxygen fraction which is enriched in these components, in particular the methods mentioned above. The customary feed for the system 202 for krypton/xenon production is the oxygen fraction 24 which is taken off from the bottom of the low-pressure column. In addition, in the process of the invention, the purified purge fraction downstream of purification stage 17 is fed in part or in whole via line 201 to the system 202 for krypton/xenon production, more precisely, preferably in the liquid state. It can in particular be fed in at a suitable point into an exchange column which serves for producing a krypton- and xenon-containing, but oxygen-free, mixture, or into another column for pre-enrichment of krypton and/or xenon. The feed point is below the top of the corresponding column.

In the illustrative example of FIG. 3, an intermediate fraction 340 is taken off from the pressure column 6 in the liquid state at the height of the takeoff of the oxygen-enriched fraction 13 or above that. It is brought in the liquid state to an increased pressure of 7 bar, for example, via a pump 341 and then fed via line 342 to the main heat exchanger 4. There, it is vaporized under the increased pressure and warmed to an intermediate temperature. The warmed intermediate fraction is passed via line 335 to an expansion machine 336. Downstream of the work expansion 336 it is fed via line 337 to the low-pressure column 7 at an intermediate point or is removed as product.

A heating medium which is taken off from the pressure column 6 in the gaseous state from an intermediate point (alternatively from the top) via line 330 and is warmed in the main heat exchanger 4 serves as heat source for the evaporation of the intermediate fraction 342 to be work-expanded. The warmed heating medium 331 is compressed in a compressor 332 to 8 bar, for example, and after recooling 333 is fed back to the main heat exchanger 4 (line 334). There it is cooled and finally at least in part condensed. The condensed heating medium 343 is expanded again into the pressure column, preferably at the point of its takeoff via line 330 or somewhat above that.

At least some of the energy required for compressing the warmed heating medium 331 is formed by the mechanical energy produced during the work expansion 336; preferably, for this purpose, the expansion machine 336 and the compressor 332 are mechanically coupled.

In the example shown in the drawing, the takeoff points of the intermediate fraction to be work-expanded and of the heating medium are at the same height, that is to say at the height of the takeoff of the oxygen-enriched fraction 13. They can equally be at different heights, for example it is possible to dispose the two at different points above the takeoff of the oxygen-enriched fraction 13. As a result, the feed points into low-pressure column and pressure column are also displaced.

The process shown diagrammatically in FIG. 4 serves for producing gaseous oxygen at increased pressure by internal compression. For this purpose, liquid oxygen 423 from the low-pressure column 7 is brought in a pump 452 to an increased pressure of 9 bar for example. The liquid 453 is fed under the high pressure to the main heat exchanger 4, where it is vaporized and warmed. Via line 422 the gaseous pressurized product is taken off.

The heating fluid for vaporizing the liquid oxygen 453 is an intermediate fraction which is taken off from an intermediate point (alternatively from the top) of the pressure column 6 in the gaseous state via line 430 and is warmed in the main heat exchanger 4. The warmed heating fluid 431 is compressed to 20 bar, for example, in a compressor 432 driven by external energy and after recooling 433 is fed back to the main heat exchanger 4 (line 454). There it is cooled and at least in part condensed. The condensed heating fluid 455 is throttled back into the pressure column, preferably at the point of its takeoff via line 430 or somewhat above that. A part 434 of the intermediate fraction 430/431 from the pressure column which is compressed in the compressor 432 can be used for the production of refrigeration energy by taking it off from the main heat exchanger at an intermediate temperature (line 35) and feeding it to an expansion machine 36. The work-expanded fraction is fed via line 37 downstream of the work expansion 36 to the low-pressure column 7 at an intermediate point. Alternatively, it can be fed back into the pressure column 6 via the line 451 which is shown in dashed lines.

The variants of FIGS. 3 and 4 can be combined with the krypton/xenon production according to FIG. 2.

What is claimed is:

1. A process for the low-temperature fractionation of air comprising introducing compressed and prepurified feed air (3, 5) into a rectification system for nitrogen-oxygen separation, which system has a pressure column (6), feeding at least a part of the compressed and prepurified feed air (5) to a feed point in the pressure column (6), withdrawing an oxygen-enriched fraction (13) in the liquid state from at least one theoretical or actual plate (15) above said feed point and passing (14), said oxygen-enriched fraction (13) to a further working step (7) within the rectification system, withdrawing a purge fraction of feed air enriched in low volatility constituents (16) in the liquid state from the bottom of the pressure column (6) at a point below said feed point, feeding said purge fraction in the liquid state to a purification stage (17) to remove $N_2O$ and withdrawing a purified fraction (18) from the purification stage (17).

2. Process according to claim 1, in which $N_2O$ is removed from the purge fraction (16) in the purification stage (17) by physical adsorption.

3. Process according to claim 1, in which the purge fraction is evaporated by indirect heat exchange in the purification stage, $N_2O$ precipitating out as solid and/or liquid in the evaporation.

4. Process according to claim 1, in which $N_2O$ is removed from the purge fraction in the purification stage by countercurrent mass transfer.

5. Process according to claim 1, in which the purified purge fraction (18) is fed at least in part to a system (202) for producing krypton and/or xenon.

6. Process according to claim 1, in which the entire feed air (1, 3, 5) which is fractionated in the rectification system is introduced into the pressure column (6).

7. Process according to claim 1, in which an intermediate fraction (30; 340; 430) is taken off from the pressure column (6) at least one theoretical or actual plate above the point at which the compressed and prepurified feed air is fed (5), and this intermediate fraction (30, 31, 34, 35; 340, 342, 335; 430, 431, 434, 35) is work-expanded (36; 336).

8. Process according to claim 7, in which the intermediate fraction is taken off (340) from the pressure column (6) in the liquid state upstream of the work expansion (336), subjected in the liquid state to a pressure increase (341), vaporized and warmed by indirect heat exchange (4).

9. Process according to claim 1, in which a product stream (423) is brought (452) in the liquid state to pressure, vaporized against a heating fluid (454) under high pressure and removed as pressurized product (422), with the heating fluid used being a gas fraction (430, 431, 454) which is taken off (430) from the pressure column (6) at least one theoretical or actual plate above the point at which the compressed and prepurified feed air is fed (5).

10. Process according to claim 1, in which a part of the bottom liquid of the pressure column is vaporized and the resultant gas is passed back to the pressure column.

11. A process according to claim 1, wherein at least a portion of said liquid state oxygen-enriched portion is fed directly to a low pressure column.

12. A process according to claim 1, wherein the purge fraction amounts to 0.1 mol % of the feed air.

13. A process according to claim 1, wherein the purge fraction amounts to 0.3 mol % to 5 mol % of the feed air.

14. A process according to claim 1, wherein the oxygen enriched feed air is withdrawn from 1 to 10 theoretical or actual plates above said feed point.

15. A process according to claim 1, wherein the oxygen enriched feed air is withdrawn from 3 to 5 theoretical or actual plates above said feed point.

16. An apparatus for the low-temperature fractionation of air having a rectification system for nitrogen-oxygen separation which has at least one pressure column (6) having a feed line (1, 3, 5) for introducing compressed and prepurified feed air into the pressure column (6), having at least one crude oxygen line (13, 14, 340) for an oxygen-enriched fraction which is connected at one end to the pressure column (6) and at the other to a further apparatus (7) within the rectification system for nitrogen-oxygen separation, having a purge liquid line (16) which is connected to the bottom of the pressure column (6) and to a purification device (17) for removing $N_2O$, and having a mass transfer section (15) comprising at least one theoretical or actual plate in scope and is disposed in the pressure column (6) between the crude oxygen line (13) and the bottom of the pressure column.

17. An apparatus according to claim 16, in which the column comprises two sections separate from one another, the first section (precolumn) being connected to the feed air line and the purge liquid line and comprising at least a part of the mass-transfer section between the crude oxygen line and the bottom of the pressure column, with a gas line connecting the top of the first section to the lower region of the second section and the second section being connected to the crude oxygen line.

18. An apparatus according to claim 11, further comprising a low pressure column and wherein a crude oxygen line is connected directly from the pressure column to the low pressure column.

* * * * *